United States Patent [19]

Van Duyn et al.

[11] Patent Number: 4,940,359

[45] Date of Patent: Jul. 10, 1990

[54] CHEMICAL SAFETY CONDUIT OR TRENCH

[75] Inventors: Phillip L. Van Duyn, Akron; Jorg R. Barenwald, Chardon; Kenneth E. Kruse, Solon, all of Ohio

[73] Assignee: ACO Polymer Products, Inc., Chagrin Falls, Ohio

[21] Appl. No.: 312,892

[22] Filed: Feb. 17, 1989

[51] Int. Cl.[5] ..... E01F 5/00

[52] U.S. Cl. ..... 405/118; 405/126; 405/128; 73/49.2; 404/2; 404/4

[58] Field of Search ..... 405/128, 129, 118, 126, 405/119-121; 73/40.5 R, 49.2 R, 49.2 T; 340/605; 404/2, 8, 4,

[56] References Cited

U.S. PATENT DOCUMENTS

| | | | |
|---|---|---|---|
| 2,821,154 | 1/1958 | Tennison | 403/300 X |
| 3,225,545 | 12/1965 | Flegel | 404/2 X |
| 3,848,765 | 11/1974 | Dürktop | 73/49.2 X |
| 4,640,643 | 2/1987 | Williams | 405/118 X |
| 4,741,645 | 5/1988 | Butler | 405/118 |
| 4,744,137 | 5/1988 | Palazzo | 73/49.2 T X |

FOREIGN PATENT DOCUMENTS

| | | | |
|---|---|---|---|
| 1108012 | 8/1979 | Japan | 73/49.2 |

OTHER PUBLICATIONS

Miller et al., "Vinyl Concrete Channels Handle Acid Waste", reprint from *Plant Services,* Feb., 1985.

"ACO Shield TM Chemical Resistance Guide", No. 121, p. 1.

Crocker et al., "Prefabricated Floor Drains of Acid Resistant Concrete Expedite Plant Expansion", reprint from *Chemical Processing,* Apr. 1983.

"ACO Drain Product Catalogue & Installation Notes", No. 5.19/ACO, 11/83, pp. 1, 2, 7, 14, 15.

"ACO Drain Product Catalogue & Installation Notes", No. 5.19/ACO, 11/84, pp. 1, 2, 7, 14, 15.

*Primary Examiner*—Dennis L. Taylor

*Assistant Examiner*—Franco S. DeLiquori

*Attorney, Agent, or Firm*—Watts, Hoffmann, Fisher & Heinke

[57] ABSTRACT

An elongate safety conduit or trench for receiving chemical liquids, having first and second preassembled conduit elements, the first located and retained within the second. A space is between the two at the bottom for collecting liquid that may leak through the first. A seal along the length of the conduit between the two elements inhibits entry of liquid between the two.

21 Claims, 5 Drawing Sheets

CHEMICAL SAFETY CONDUIT OR TRENCH

TECHNICAL FIELD

This invention relates to safety conduits for chemical fluids and more particularly to a precast polymer concrete safety trench for collecting chemical liquids to protect the environment against spills or leaks.

BACKGROUND ART

Trench drains of polymer concrete have found many uses where high strength and durability justify the increased cost over tile, concrete, and other ceramic materials. Such drains are typically channel-shaped conduits, open at the top, and recessed into a surface, such as a floor, to catch liquid run-off from spills or leaks. However, where the liquid that may spill or leak or otherwise require collection is environmentally unsafe, such as hazardous chemical liquids, the Environmental Protective Agency of the U.S. government has required secondary containment in addition to the primary container to inhibit any such liquid from escaping into the environment.

DISCLOSURE OF INVENTION

This invention provides a double-walled conduit especially suitable for use as a safety trench drain or conduit for collecting or conveying, or both, chemical fluids in an environmentally safe manner. The conduit is constructed to guard against leakage, is chemically resistant, nonporous, and structurally strong. In a preferred embodiment of the invention, the conduit is formed of two initially separate channel members pre-assembled, one within the other, of convenient modular length for shipment, assembly, and use, and that can conveniently be joined, one to the next, in a sealed relationship during installation. To assure high strength at junctures between pre-assembled conduit members of discrete length and to inhibit any leakage through both the inner and outer channel at junctures of adjacent modular lengths or sections, one end of the inner channel extends beyond the adjacent end of the outer channel in which it is received, while the opposite end terminates short of the adjacent end of the outer channel. This offset at each end provides a "running bond" relationship that also helps align the sections and provides additional surfaces by virtue of intermeshing end parts that facilitate the creation of liquid-proof seals and bonds between adjacent sections with a flowable sealant adhesive.

The inner and outer channel members in the preferred embodiment are formed of polymer concrete, i.e., a resin and a refractory filler. Most preferably the resin is a vinyl polymer or a polyester polymer and the filler is predominantly or entirely quartz. With these materials, the conduit or trench is nonporous, impervious to attack by frost, oil, most acids and alkalies, and will withstand impact, vibration and heavy localized loadings. Each channel is up to approximately four times the strength of an equivalent cement concrete channel.

In its broader aspects, the invention provides an elongate safety conduit for receiving chemical liquids, and includes first and second conduit elements, each having imperforate bottom and side wall portions. The first conduit element is located and retained within the second and is constructed and arranged to allow liquid access into the first or inner element from outside the second or outer element that has bottom and side wall portions enveloping those of the first. A space is provided between the outside of the bottom wall portion of the first or inner conduit element and the inside of the bottom wall of the second, suitable for collecting liquid that may leak through or past the enveloped wall portions of the first element.

A seal is provided along the length of the conduit between the two conduit elements at or adjacent to upper termini of interfaces between the enveloped and enveloping side wall portions of the two, to inhibit entry of liquid between the interfaces. In the preferred embodiment this seal also adheres the two elements together.

The space between the two bottom wall portions extends the length of the conduit and in the preferred embodiment the inside bottom surface of the second or outer element is sloped transversely to direct any liquid that may leak into the second element into a limited area to thereby increase the depth of the collected liquid. A liquid detector may be used, suitably of the common electrical type, with a sensing element or elements located in the limited area where the liquid is directed by the sloped bottom surface, to signal the presence of liquid in the second element of the conduit or trench.

These and other features of the invention will be better understood from the detailed description that follows, when considered in connection with the accompanying drawings.

BEST MODE FOR CARRYING OUT THE INVENTION

Figure 1:
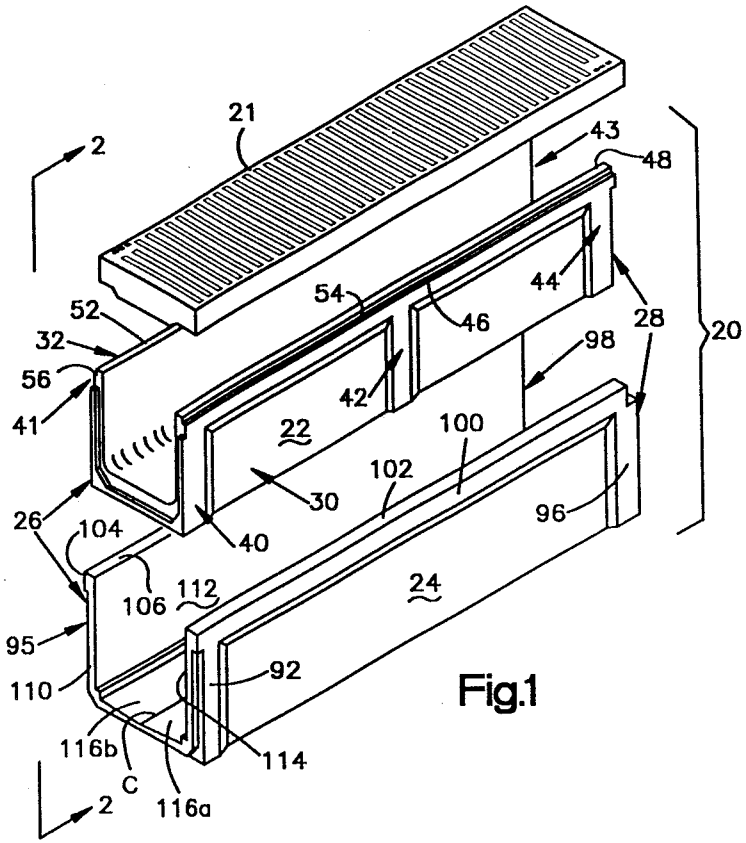
FIG. 1 is an exploded view of a safety conduit embodying the present invention.

With reference to the drawings, a safety conduit 20 of discrete length is shown embodying the invention. The discrete length may extend the entire length of the conduit, but typically the conduit 20 shown will be one of many joined end-to-end. The preferred embodiment shown is constructed for use as a trench and in use will be sunk with the top of the conduit flush with a surface from which liquid run-off is to be collected and will be covered with a grate 21 or the like through which the liquid can pass. The conduit finds primary use for collecting and conveying environmentally unsafe liquids that may find their way to the surface in which the conduit is located. To reduce the chance of leakage from the conduit, it is made of first and second elements, an inner element 22 and an outer element 24 that envelops the inner element. For convenience and ease of joining several discrete lengths of conduit 20 to provide the total conduit length desired, each discrete length is comprised of preassembled first and second, i.e., inner and outer, elements. Opposite ends 26, 28 of each length 20 are of different construction to facilitate interfitting of successive lengths. Sealant is used between adjoining ends to bond the sections together and to prevent leakage of liquid therebetween. Sections of conduit different in shape from that shown are contemplated, including end sections for terminating a conduit, T-shaped sections and L-shaped sections for joining trenches or changing direction, as well as other shapes for specialized purposes.

The inner element 22 is comprised of solid opposite and parallel side walls 30, 32 and a bottom wall 34, which are imperforate and liquid impermeable. The side walls extend at right angles to the bottom wall and the three form a channel shaped form that is preferably one-piece, molded or cast. The side walls and bottom wall have thicker reinforcing portions, three portions 40, 42, 44 being generally U-shaped, one portion 40 at an end 41 of the inner element, a second portion 44 at an opposite end 43, and a third portion 42 at the middle of the inner element; and two elongate portions, one 46 along the upper edge of the side wall 30 and forming with the upper edge a top surface 48, and another 50 along the upper edge of the side wall 32 and forming with it a top surface 52. An elongate groove 54 runs along the reinforcing portion 46 and a similar groove 56 runs along the reinforcing portion 50, each groove opening through the respective top surface 48, 52 and an outwardly facing side surface 62, 64 of the respective reinforcing portion and being step-shaped in cross section.

The end 41 of the inner element 22 has a first U-shaped end surface outer periphery 66 contiguous with outer side wall surfaces 68, 70, and with outer bottom wall surface 72, and has a second U-shaped end surface 74 forming the inner periphery of the end 41 contiguous with inner side wall surfaces 76, 78, and with inner bottom wall surface 80. The end 43 of the inner element 22 has a first U-shaped end surface 82 forming the inner periphery of the end, contiguous with the surfaces 76, 78, 80; and a second U-shaped end surface 84 forming the outer periphery of the end, contiguous with the surfaces 68, 70, 72. The inner end surface 74 is recessed with respect to the outer end surface 66, while the outer end surface 84 is recessed with respect to the inner end surface 82. The depth of the recess formed by the end surface 74 relative to the end surface 66 at the end 41 is slightly greater than that of the recess formed by the end surface 84 with respect to the end surface 82 at the end 43 to accommodate a commercially available sealant adhesive 150 between the surfaces 74 and 82.

The outside bottom surface 72 at each reinforcing portion 40, 42, 44 forms a right angle with the outer side surfaces 68, 70 and provides a structural support for the inner element 22 within the outer element 24.

The outer element 24 is of similar but not identical shape and construction as the inner element 22. It is equal in length, but greater in width and depth, to closely receive and envelop the inner element 22. It is comprised of solid, opposite and parallel, side walls 86, 88 and a bottom wall 90, which are imperforate and liquid impermeable. The side walls are at right angles to the bottom wall and the three create a channel-shaped form that is preferably one-piece, either molded or cast. The side walls have thicker reinforcing portions at each end, two portions 92, 93 at an end 95 of the outer element and two portions 96, 97 at an opposite end 98; and two elongate portions, 100 along the upper edge of the side wall 86 and forming with the upper edge a top surface 102, and another portion 104 along the upper edge of the side wall 88 and forming with it a top surface 106.

Figure 7:
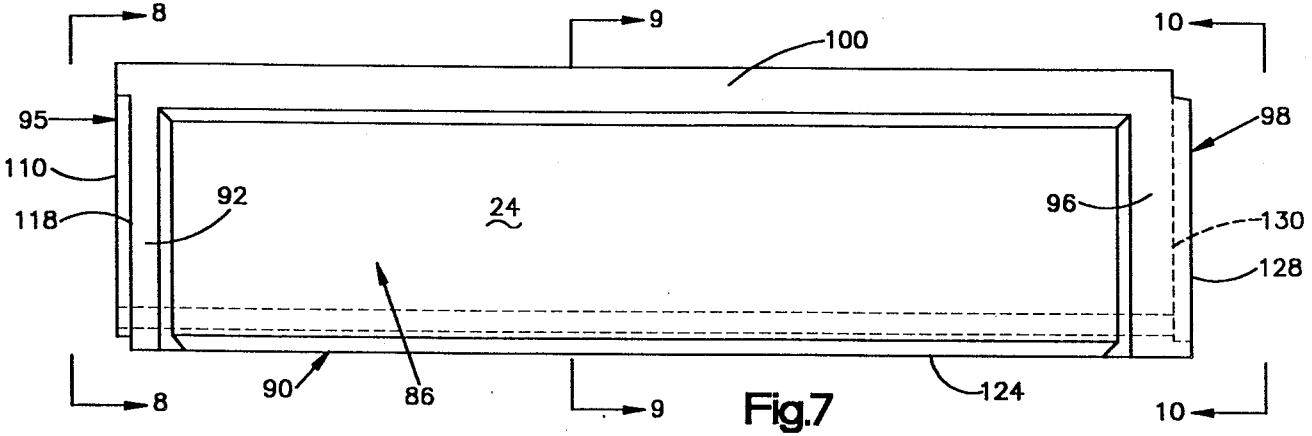
FIG. 7 is a side elevational view of the outer channel element of the safety conduit of FIG. 1.
Figure 10:
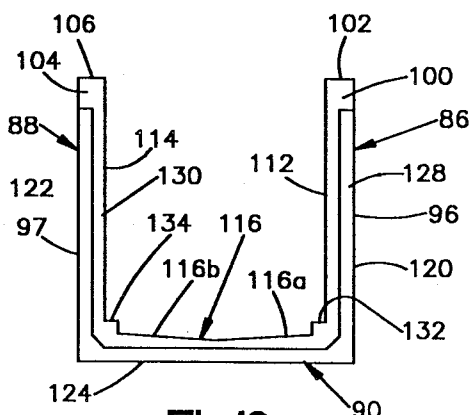
FIG. 10 is an end elevational view of the element of FIG. 7 taken along the line 10—10.
Figure 9:
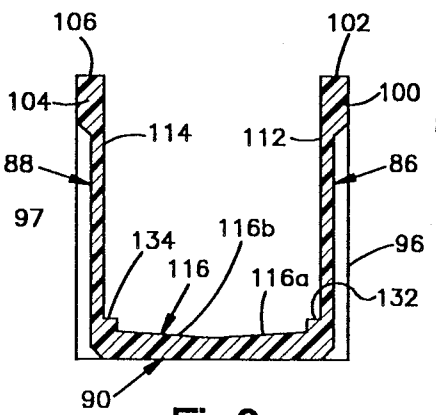
FIG. 9 is a transverse sectional view of the element of FIG. 7 taken along the line 9—9.
Figure 8:
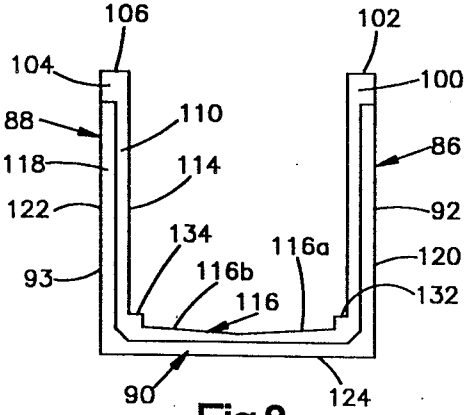
FIG. 8 is an end elevational view of the element of FIG. 7 taken along the line 8—8.
Figure 11:
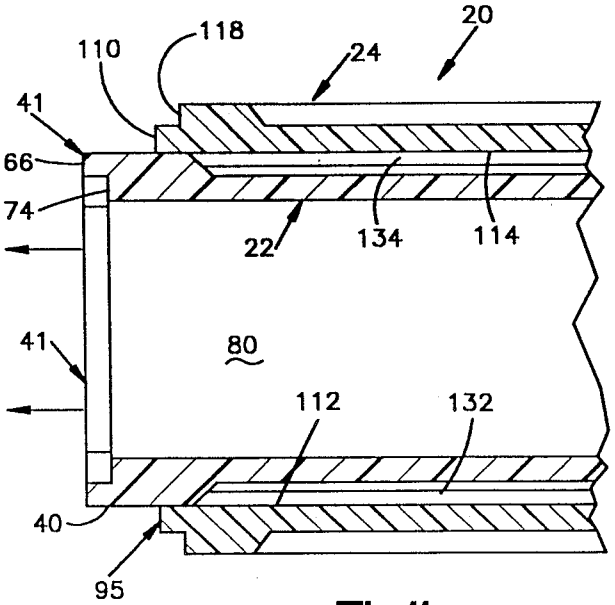
FIG. 11 is a partial longitudinal sectional view of the end of the safety conduit shown in FIG. 2 taken along the line 11—11.
Figure 12:
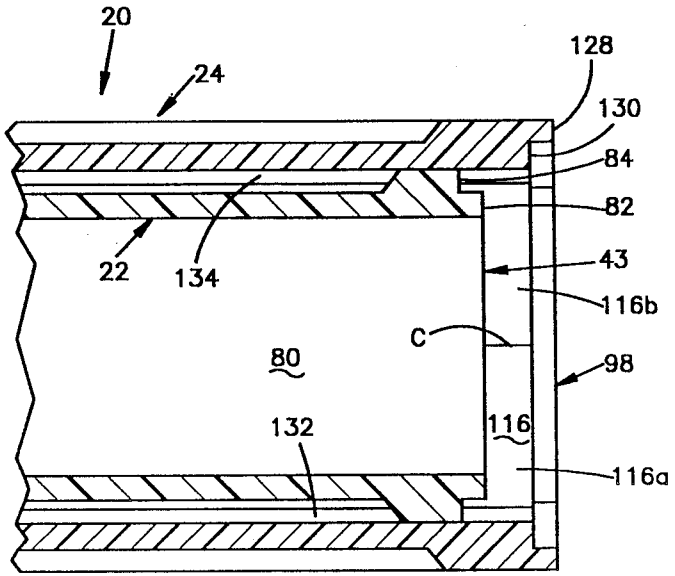
FIG. 12 is a partial longitudinal sectional view of the other end of the safety conduit than that shown in FIG. 2 taken along the line 12—12.
Figure 13:
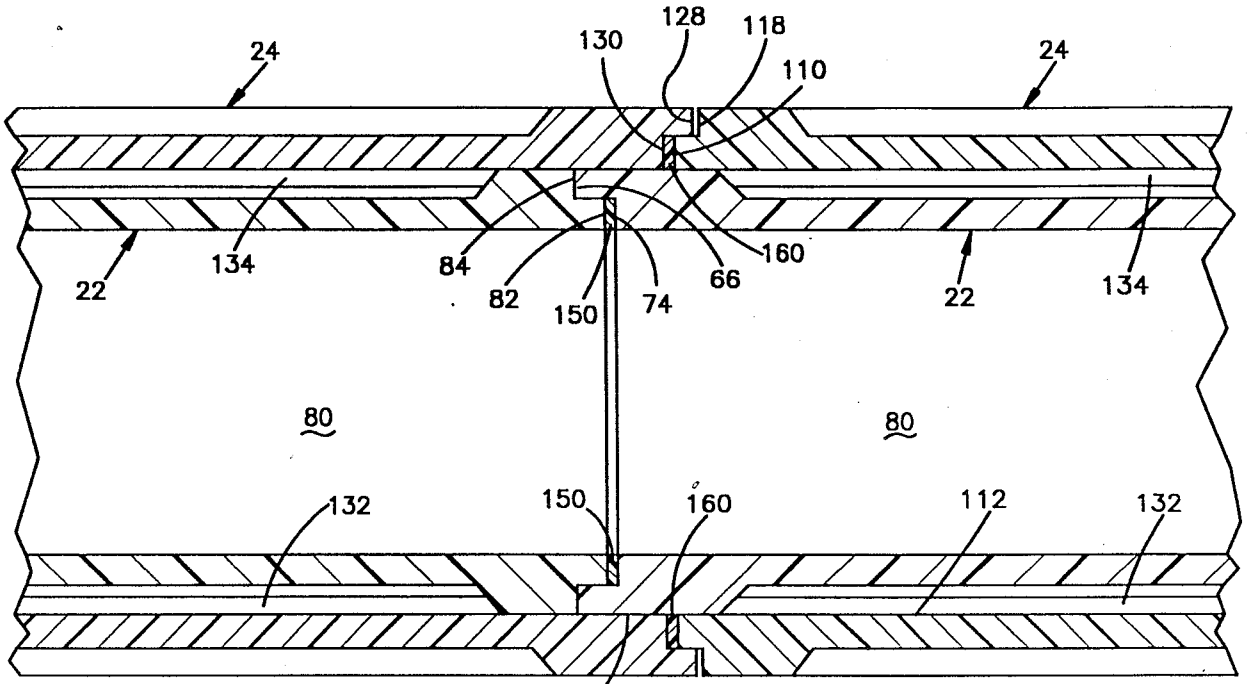
FIG. 13 is a partial longitudinal section view of the two abutting discrete lengths.

The end 95 of the outer element 24 has a first U-shaped end surface inner periphery 110 contiguous with inner side wall surfaces 112, 114, and with an inner bottom wall surface 116, and has a second U-shaped end surface 118 forming the outer periphery of the end surface, contiguous with outer side wall surfaces 120, 122, and with an outer bottom wall surface 124. The other end 98 of the outer element 24 has a first U-shaped end surface outer periphery 128 contiguous with surfaces 120, 122, 124, and a second U-shaped end surface inner periphery 130, contiguous with the surfaces 112, 114, 116. As shown in FIGS. 7, 11 and 12, the outer end surface 118 is recessed with respect to the inner end surface 110, while the inner end surface 130 is recessed with respect to the outer end surface 128. The depth of the recess formed by the end surface 130 relative to the end surface 128 at the end 98 is slightly greater than that of the recess formed by the end surface 118 with respect to the end surface 110 at the end 95 to accommodate a sealant adhesive 160 between the surfaces 130 and 110.

The inner width of the outer element 24, that is, the width between the inside wall surfaces 112, 114 is equal to the width of the reinforcing portions 40, 42, 44 of the inner element 22, but with a slight oversize to accommodate a clearance fit of the inner element within the outer. A narrow longitudinal step 132, 134 is formed adjacent to the base of each side wall 86, 88, at the inner side wall surfaces 112, 114, slightly above the inner bottom wall surface 116 of the bottom wall 90, so as to extend inwardly from the side wall into the interior of the outer element. The outside bottom surface 72 of each reinforcing portion 40, 42, 44 of the inner element 22 rests on the narrow steps 132, 134, which thereby support the inner element above the inner bottom wall surface 116 of the outer element. This results in a space 136 between the inner and outer elements, extending the length of the conduit 20. The inner bottom wall surface 116 is sloped transversely of the longitudinal extent of the element. In the preferred embodiment shown, the bottom inside surface has two portions **116*a*, 116*b*** that slope in opposite directions, from the side walls inwardly, increasing the depth along a longitudinal center line C, which is the lowest level of the bottom inside wall. This construction serves to direct and collect any liquid that lies on the bottom inside wall, into a limited area of increased depth, to facilitate detection of the liquid.

The height of the side walls 86, 88 of the outer element 24 is greater than that of the side walls 30, 32 of the inner element 22, so as to completely envelop the side walls of the inner channel and to extend above the top surfaces 48, 52 a distance sufficient to accommodate the depth of the grate 21. The grate has a width equal to that between the inner side wall surfaces 112, 114 of the outer element, plus a slight clearance to accommodate a clearance fit. With this arrangement, the grate fits within the outer element, recessed flush with the top surfaces 102, 106 and rests on the top surfaces 48, 52 of the inner element.

A commercially available sealant adhesive is placed within the grooves 54, 56 after the inner element is placed within the outer element. The sealant adhesive 140 extends the entire length of the conduit 20, adheres the inner element to the outer element, and provides a liquid-proof seal between the side walls of the two elements, to prevent liquid entering the inner channel through the grate from finding its way into the interface between the facing surfaces of the side walls of the inner and outer elements.

Figure 2:
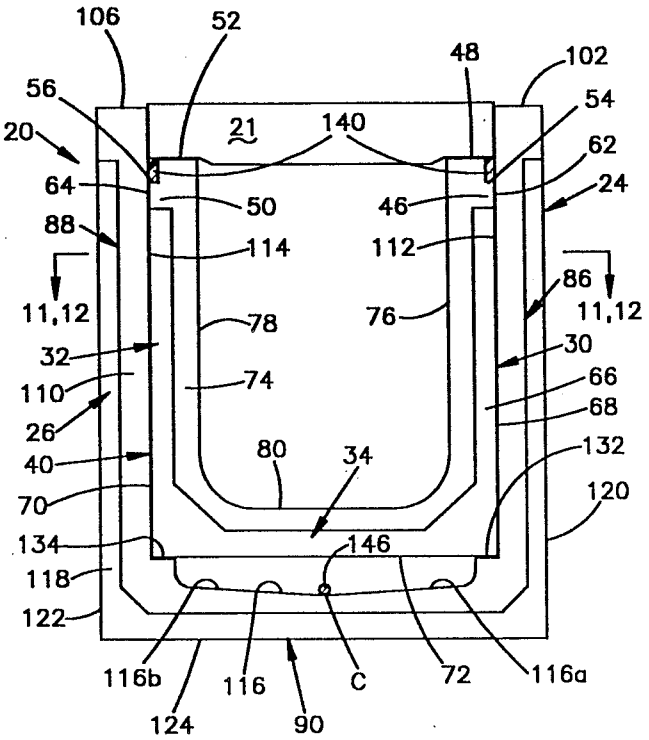
FIG. 2 is an end elevational view of the conduit of FIG. 1 with the parts assembled and viewed from the line 2—2.
Figure 3:
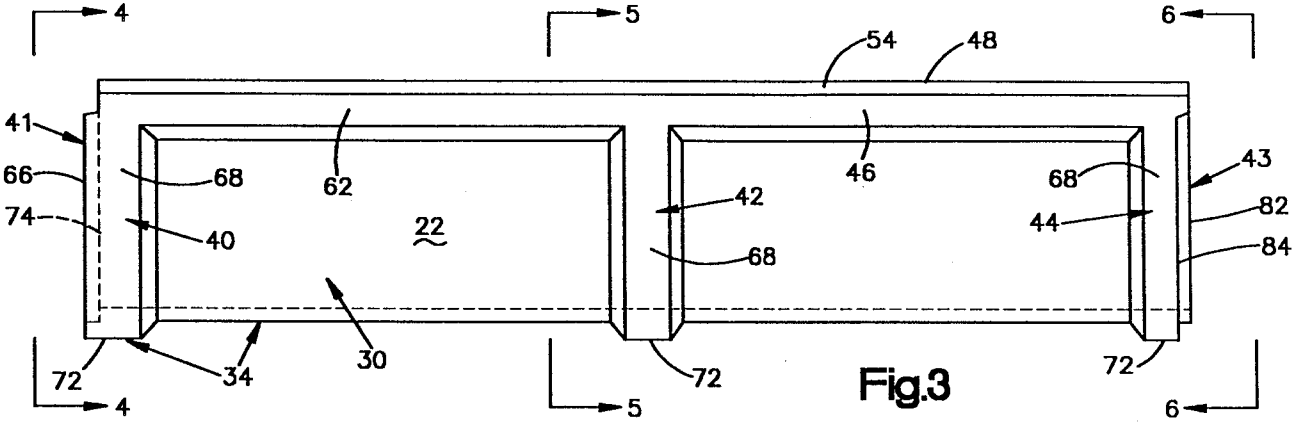
FIG. 3 is a side elevational view of the inner channel element of the conduit of FIG. 1.
Figure 6:
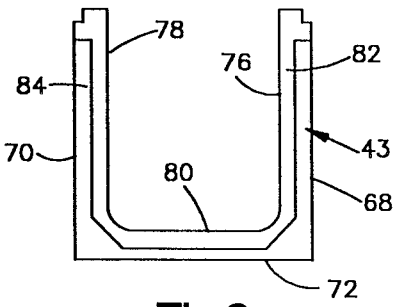
FIG. 6 is an end elevational view of the inner channel element of FIG. 3 taken along the line 6—6.
Figure 5:
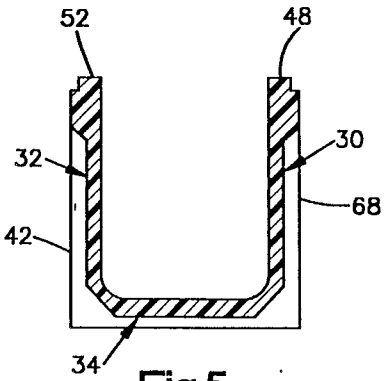
FIG. 5 is a transverse sectional view of the inner channel element of FIG. 3 taken along the line 5—5.
Figure 4:
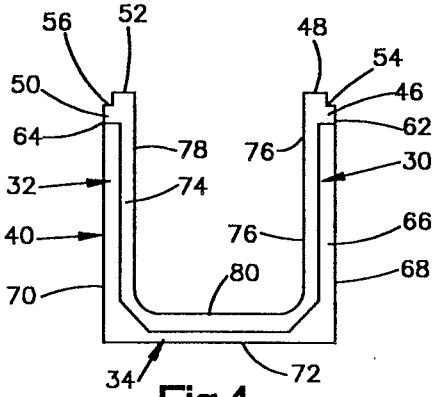
FIG. 4 is an end elevational view of the inner channel element of FIG. 3 taken along the line 4—4.

A liquid detector element indicated diagrammatically as a longitudinal detector wire 146 in FIG. 2 is preferably located in the outer channel along the central juncture C between the transversely sloped surfaces 116*a*, 116*b* where the depth of any collected liquid is greatest. The detector may be of any known type, but one type has a detecting wire or the like that would extend along the conduit and serve to signal the presence of liquid in the space 136, which might result from any breach of the integrity of the conduit construction that would result in leakage from the inner channel to the outer.

Satisfactory polymer composites or so-called concretes and adhesive sealants of the type useful for the present safety conduit in forming the inner and outer elements 22, 24, adhering them together and sealing interfaces therebetween, have been used by ACO Polymer Products, Inc., Chagrin Falls, Ohio, the assignee of this application, for other precast trench drain systems and are known in the art. The polymer composites are comprised of a base liquid polymer resin, a mineral or synthetic aggregate filler, a catalyst, and an accelerator. The mixture is polymerized through chemical reaction in a mold. Preferred embodiments of the present invention, in order to achieve the desired chemical resistance, utilize vinyl ester resin (a vinyl polymer) or polyester resin, each composition having somewhat different chemical resistance for different applications, and a quartz filler. The preferred sealant is elastomeric, adhesive and chemically resistant, comprised of a vinyl ester and is marketed by ACO Polymer Products, Inc. under the trademark "Vinyl-seal."

The polymer concrete of either preferred composition has a compressive strength of approximately 14000 psi or greater (ASTM C39-84), a tensile strength of approximately 1500 psi or greater (ASTM C78-84), and a moisture absorption of less than 0.2 (surface wetting only) (ASTM C140-75).

It is contemplated that other suitable materials having satisfactory properties may be used and that modifications or alterations may be made in the particular embodiment disclosed, without departing from the spirit and scope of the invention set forth in the claims.

We claim:

1. An elongate safety conduit for receiving liquids, comprising:

first and second precast polymer concrete conduit elements each having imperforate bottom and side wall portions, the first conduit element located and retained within the second and constructed and arranged to allow liquid access thereto from outside the second, the second conduit element bottom and side wall portions enveloping those of the first, means within the second conduit element for engaging the first conduit element and positively locating the first conduit element above the bottom wall of the second conduit thereby providing a space between the outside of the bottom wall portion of the first conduit element and the inside of the bottom wall of the second suitable for collecting liquid that may leak through the enveloped wall portions, and seal means along the length of the conduit between the two conduit elements at or adjacent to upper termini of interfaces between the enveloped and enveloping side wall portions of the two to adhere the two elements together and inhibit entry of liquid between said interfaces.

2. A conduit as set forth in claim 1 wherein said space extends essentially the length of said conduit.

3. A conduit as set forth in claim 1 wherein the inside bottom surface of the second element is at least in part sloped transversely.

4. A conduit as set forth in claim 3 including a liquid detector in said space at the bottom of the sloped part of the inside bottom surface.

5. A conduit as set forth in claim 1 wherein each conduit element is channel shaped.

6. A conduit as set forth in claim 1 wherein one or more openings above the side wall portions provide access to the first element along the length of the element.

7. A conduit as set forth in claim 1 wherein the first element is bonded to the second.

8. A conduit as set forth in claim 1 wherein the sidewalls of the second element extend above the sidewalls of the first.

9. A conduit as set forth in claim 8 wherein the sidewalls of the first element terminate in surfaces transverse to the sidewalls of the second adapted to support a perforate cover for the conduit within the sidewalls of the second element.

10. A conduit as set forth in claim 9 including a perforate cover.

11. A conduit as set forth in claim 1 wherein the means for providing said space is an extending abutment integral with one of said elements and limits the depth to which the first element is received in the second.

12. A conduit as set forth in claim 1 wherein each element is formed of discrete lengths that abut one another, and junctures between discrete lengths of the first element are offset longitudinally from junctures of discrete sections of the second element.

13. A conduit as set forth in claim 12 including means sealing abutted ends of said sections against liquid flow therebetween.

14. A conduit as set forth in claim 1 wherein said elements are made of resin and refractory filler.

15. A conduit as set forth in claim 14 wherein the resin is a vinyl ester polymer or a polyester polymer.

16. A conduit as set forth in claim 14 wherein the filler is predominantly quartz.

17. A conduit as set forth in claim 1 including means recessed with respect to a top surface of the second element for supporting a cover flush with the top of the second element.

18. An elongate safety conduit for collecting liquids, comprising:

first and second conduit elements each in the form of an open-topped channel-shaped member having substantially liquid impermeable bottom and side wall portions, the first conduit element located and retained within the second and constructed and arranged to receive liquid through the open top, the second conduit element enveloping the first and the sidewall portions extending upward beyond those of the first, support means within the second conduit element for spacing at least a portion of the outside bottom surface of the first element above the inside bottom surface of the second to provide a space therebetween, said space extending essentially the length of said conduit and suitable for collecting liquid that may leak through the first element, each element being formed of discrete sections that abut one another, discrete sections of the first element overlapping abutted ends of discrete sections of the second element, means adhering abutted ends of said sections together and sealing against liquid flow therebetween; and a seal element along the length of the conduit at the junction between the top of each side wall of the first element an the inner surface of each sidewall of the second element to inhibit entry of liquid between the two elements and to adhere the two elements together.

19. A conduit as set forth in claim 18 wherein the inside bottom surface of the second element is at least in part sloped transversely.

20. A conduit as set forth in claim 18 including means to detect liquid in said space.

21. An elongate safety conduit for receiving liquids, comprising:

first and second precast conduit elements each in the form of an open-topped channel, each made of a resin of a vinyl ester polymer or a polyester polymer and a refractory filler predominantly quartz having imperforate bottom and side wall portions, the first conduit element located and retained within the second and constructed and arranged to allow liquid access thereto from outside the second, the second conduit element bottom and side wall portions enveloping those of the first, the side wall portions extending upward beyond those of the first and the inside bottom surface of the second element being at least in part sloped transversely, support means within the second conduit element for spacing at least a portion of the outside bottom surface of the first element above the inside bottom surface of the second to provide a space therebetween, said means comprising an abutment integral with one of said elements that limits the depth to which the first element is received in the second, said space extending essentially the length of said conduit, and suitable for collecting liquid that may leak through the first element and including means to detect liquid in said space at the bottom of the sloped part of the inside bottom surface of the second element, means along the length of conduit between the two conduit elements at or adjacent to upper termini of interfaces between the enveloped and enveloping side wall portions of the two to inhibit entry of liquid between said interfaces and to adhere the two elements together, each element being formed of discrete sections that abut one another, discrete sections of the first element overlapping abutted ends of discrete sections of the second element, means adhering abutted ends of said sections and sealing against liquid flow therebetween, means for supporting a cover within the second element recessed flush with the top surface of the second element, the side walls of the second element extending above the sidewalls of the first and the first terminating in surfaces transverse to the sidewalls of the second, and a perforate cover supported on top of said transverse surfaces of the first element.

* * * * *